US007992767B1

(12) United States Patent
Holmes

(10) Patent No.: US 7,992,767 B1
(45) Date of Patent: Aug. 9, 2011

(54) ROTARY SAFETY MAILBOX

(76) Inventor: Reed Leadrew Holmes, Far Hills, NJ (US)

( * ) Notice: Subject to any disclaimer, the term of this patent is extended or adjusted under 35 U.S.C. 154(b) by 0 days.

(21) Appl. No.: 12/098,206

(22) Filed: Apr. 4, 2008

Related U.S. Application Data

(60) Provisional application No. 60/910,140, filed on Apr. 4, 2007.

(51) Int. Cl.
*A47G 29/12* (2006.01)

(52) U.S. Cl. ..... 232/39; 248/131; 248/145; 248/219.2

(58) Field of Classification Search ..... 232/39; 248/131, 145, 371, 415, 417, 219.2, 125.7
See application file for complete search history.

(56) References Cited

U.S. PATENT DOCUMENTS

| | | | | |
|---|---|---|---|---|
| 1,053,082 | A | | 2/1913 | Yeakel |
| 1,273,696 | A | | 7/1918 | Vanhoof |
| 2,522,983 | A | | 9/1950 | Bergstrom |
| 2,605,073 | A | | 7/1952 | Buck |
| 2,683,013 | A | | 7/1954 | Amundson et al. |
| 2,902,211 | A | * | 9/1959 | Franklin ..... 232/17 |
| 3,407,997 | A | | 10/1968 | Wood et al. |
| 3,899,150 | A | | 8/1975 | Racquet |
| 4,113,213 | A | | 9/1978 | Gary et al. |
| 4,130,239 | A | | 12/1978 | Belsheim |
| 4,955,533 | A | | 9/1990 | Merkle |
| 4,995,576 | A | | 2/1991 | Kieswetter |
| 5,215,283 | A | | 6/1993 | Gould |
| 5,437,409 | A | | 8/1995 | Coushaine |
| 5,458,286 | A | | 10/1995 | Paschal |
| 5,524,853 | A | | 6/1996 | Varlaro |
| 5,622,343 | A | | 4/1997 | Morton |
| 5,699,989 | A | * | 12/1997 | Guthrie ..... 248/219.2 |
| 5,779,202 | A | | 7/1998 | Black |
| 7,108,445 | B2 | * | 9/2006 | Henriques ..... 403/202 |
| 7,249,704 | B1 | | 7/2007 | Smith |
| 7,559,457 | B2 | * | 7/2009 | Webber ..... 232/39 |
| 2007/0138249 | A1 | * | 6/2007 | Webber ..... 232/39 |

* cited by examiner

*Primary Examiner* — William L. Miller
(74) *Attorney, Agent, or Firm* — Charles A. Wilkinson; Clinton H. Wilkinson

(57) ABSTRACT

A canted swivel for a mailbox to provide an automatic swiveling mailbox arrangement enabling retrieval of mail from the box without entering a nearby thoroughfare with the mailbox having a rest point or balance point facing outward toward the thoroughfare at its balance point as a result of a canted ball bearing swivel.

10 Claims, 3 Drawing Sheets

16
14
10
12
S
H
20
22
24
26
18
19

14a
H
16
S
10
26
22
20
24
12
19
18
14b

ROTARY SAFETY MAILBOX

RELATED APPLICATION

This application takes priority from U.S. Provisional Application 60/910,140, filed Apr. 4, 2007, in the name of Reed Leadrew Holmes.

BACKGROUND OF THE INVENTION

1. Field of the Invention

This invention relates to mailboxes and particularly to mailboxes used along country and other roads and more particularly to rendering such mailboxes safer for the owners to retrieve mail from as well or place mail in for collection. More particularly still the invention relates to a canted ball bearing arrangement for providing automatic swiveling for roadside rural mailbox support.

2. Description of the Prior Art

Mailboxes on posts or sometimes more substantial pedestals have been used for many decades along roads and other transportation routes particularly where there are no sidewalks for mail carriers to traverse. Such mailboxes traditionally extend from the side of the road close enough to the roadway itself so that a postman or woman in a mail delivery vehicle of some design, usually with a so-called right hand drive, can reach out of the vehicle and opening the usual pivoted door on the mailbox first retrieve any mail in the box and then insert mail which the mail carrier is delivering into the mailbox for pick-up by the owner of such mailbox. Since the mailbox necessarily extends extremely close to the road, however, and opens to the front, it is necessary for the owner of the box to step out onto the side of the road in order to access the box, where, however, such owner, as roads have become more crowded, runs the risk of being struck by traffic. Older citizens who are neither as alert nor as nimble in avoiding danger run a particular risk in such circumstances.

Some mailboxes have been provided with an opening at each end so that the owner can access the end away from the road and the mail carrier can access the roadside end. However, with a large mailbox, the owner then often finds the mail deposited mostly on the roadside and will prefer to access the box on the roadside in order to avoid having to stretch their arm deeply into the box.

The doors on mailboxes are often also not particularly tight, even if securely shut, so that rain may gain access to the box. For this reason, the box will usually be inclined slightly downwardly toward the front so that drainage will be outwardly rather than inwardly. If there is an opening at both ends, however, any leakage into the box on the higher end will run down to the other end dampening mail resting on the bottom.

It is believed that a mailbox pivoted for varied access and provided with a lever to rotate the box may have already been suggested, but to the present applicant's best knowledge no automatically rotating mail boxes have been previously available.

OBJECTS OF THE INVENTION

It is an object of the present invention, therefore, to provide a rotary mailbox which is easily rotatable on its post or pedestal to enable the owner to rotate the front mail receiving end away from a road to retrieve mail placed in it from the roadside through the same end.

It is a still further object of the invention to provide a rotatable mailbox which is adapted to automatically rotate to a roadside position for the placement of mail in it, but which can be easily rotated to face away from the road to enable the user thereof to retrieve mail.

It is a still further object of the invention to provide automatic rotation of a mailbox back into mail receiving position by mounting such mailbox on an at least slightly canted or inclined set of ball bearings with the major weighted end overlapping of the box above the lower end of the ball bearing race so natural rotation will be toward the roadside.

It is a still further object of the invention to provide a canted bearing arrangement between two support plates for rotatably mounting a mailbox on a support to enable the mailbox to be automatically swiveled from a mail retrieval position to a mail delivery position after delivery and retrieval of mail.

Other objects and advantages of the invention will become evident from review of the following description and appended claims.

SUMMARY OF THE INVENTION

This invention provides a swiveling or rotating mailbox which automatically assumes a road facing position through the action of gravity when not physically turned or restrained, but which can be swiveled by hand to face in the opposite direction when the owner of the box wishes access thereto. Automatic unrestrained swiveling is attained by mounting the box on a canted or inclined ball bearing race mounted in turn on a mailbox post or pedestal with the box extending farther from the swivel point on its access side than on the non-access side such that the weight balance of the mailbox will be toward the road along which it is used, allowing gravity to bias its access end and door toward the roadside.

DESCRIPTION OF THE PREFERRED EMBODIMENTS

Figure 1:
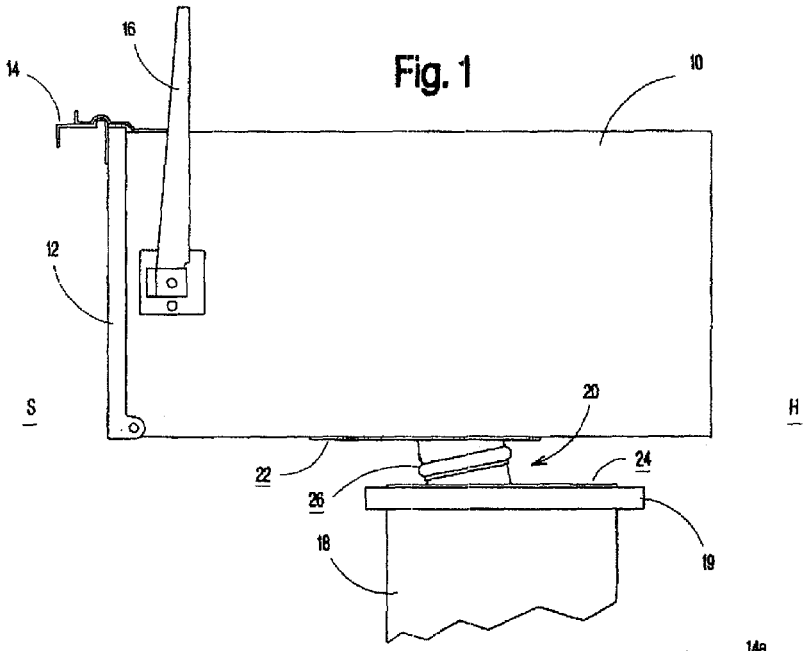
FIG. 1 of the attached drawings shows a side elevation of a typical mailbox mounted upon a rotatable support in accordance with the invention in turn mounted upon a base pedestal or typical support post with the mailbox rotated toward the street side (s).

The following is a detailed description of the best mode or modes of the invention presently contemplated. Such description is not intended to be understood in a limiting sense, but to be an example of the invention presented solely for illustration thereof and by reference to which in connection with the following description and the accompanying drawings one skilled in the art may be advised of the advantages and construction of the invention.

The present invention provides a swiveling arrangement for a mailbox installation which installation enables a mailbox to be physically rotated away from a road to retrieve mail from the box or to place mail in the box for pick-up by a mail carrier. The swivel mechanism is constructed so that it will automatically, if not constrained, move the opening of the mailbox into a position in which such opening is facing the road along which the mailbox is positioned, such automatic swiveling being due to the effects of gravity acting upon the mailbox which is freely rotatable due to being mounted upon its post by means of a ball bearing race arranged canted, or at an incline, favoring forward pivoting of the mailbox mounting plate toward the road where mail delivery persons may place mail in it from a delivery vehicle.

Where sidewalks have been installed beside streets and roads, referred herein generally as thoroughfares, mail is usually delivered by a postman or woman on foot or partially on foot into mailboxes mounted upon buildings or through mail slots in the doors of homes and other buildings along the thoroughfare. Where there is no sidewalk, however, it is the custom to mount mailboxes upon posts or other supports along the highway or other thoroughfare. In order to impede traffic as little as possible as well as to speed mail delivery, this is usually done by the driver of a mail delivery vehicle having a right side drive arranged to facilitate reaching by the driver of the mail delivery vehicle from the right side window to directly deliver mail into mailboxes arranged at a convenient height along the road and extending directly to the so-called shoulder of the road to facilitate access by the delivery person reaching from the vehicle to the mailbox. The close position of the mailbox to the shoulder or berm of the road means that in order to either place letters into, or remove deposited mail from the mailbox, the householder must step onto the berm or shoulder of the highway or street where they run the risk of being struck by a vehicle proceeding along the road or street. While vehicles will normally on most thoroughfares keep more toward the center of the highway or street, there is always the chance that a driver will swerve for one reason or another toward anyone occupying the shoulder or berm and on particularly narrow streets, such deviation or swerving will take place every time vehicles pass in opposite directions or, for that matter, in the same direction. Consequently, the careful householder waits until there is no close traffic before stepping upon the berm to retrieve or deposit mail from or to a mailbox. Familiarity tends to, as they say to breed contempt, however, and both young and older people tend to be more careless so that accidents still happen particularly on busy, but narrow, roads or on roads having very little berm or shoulder.

The present invention provides an arrangement by which a homeowner or business person along a thoroughfare on which mailboxes are used, is enabled to deposit mail in an retrieve mail from a roadside mailbox without stepping in the road, but remaining instead behind the mailbox which swivels upon its mounting. Furthermore, in the present invention, the mailbox pivot is canted and the mailbox is mounted with a majority of its weight or mass positioned on a pivoting bracket beyond the center of turning so that it tends to reach a balance point when disturbed with the opening to the mailbox toward the road on a level, but which is sufficiently evenly balanced so that the mailbox can be easily rotated by hand toward the off-street side for the deposit and retrieval of mail by the owner. An easily overcome detent is provided to hold the mailbox in place so it will not tend to blow or oscillate in the wind and is preferably in a slightly forwardly depressed position to allow water and moisture to drain naturally from it.

FIG. 1 is a side elevation of a typical mailbox 10 mounted upon a canted ball bearing swivel bracket 20. Such mailboxes traditionally have straight sides, back and front and an arched or curved roof, which can be easily formed in a single piece to shed water, with a hinged down door or lid in the front facing street S which is opened for deposit and retrieval of mail. Such lid or door is frequently made of metal with side flaps or flanges which fit a short distance over the sides of the body of the box when closed to provide at least some weather sealing and a straight bottom to encourage drainage of moisture from the box when closed. The door 12, which is usually hinged at the bottom, is usually latched by a spring metal catch 14 assembly including cooperating latch components 14*a* and 14*b*. A bright colored flag or stick 16 is usually pivoted on the side near the front for raising when there is mail to be picked up either by the owner or the mail person. Usually the mailbox is designed to angle down somewhat on its bracket so that any moisture gaining entrance to the mailbox will tend to drain out through any crevice between the bottom and the pivoted door.

In the mailbox of the invention, rather than such mailbox 10 being mounted directly upon a post plate or platform 19 on top of the mailbox support post 18 it is mounted to the post 18 through a swivel mounting or bracket 20 comprised of a ball bearing race 26 arranged between two brackets, a top member, flange or bracket 22 and bottom member or bracket 24 in the form of plates which are secured respectively to the bottom of the mailbox 10 and the post plate or platform 19 secured to the top of the post 18.

Figure 2:
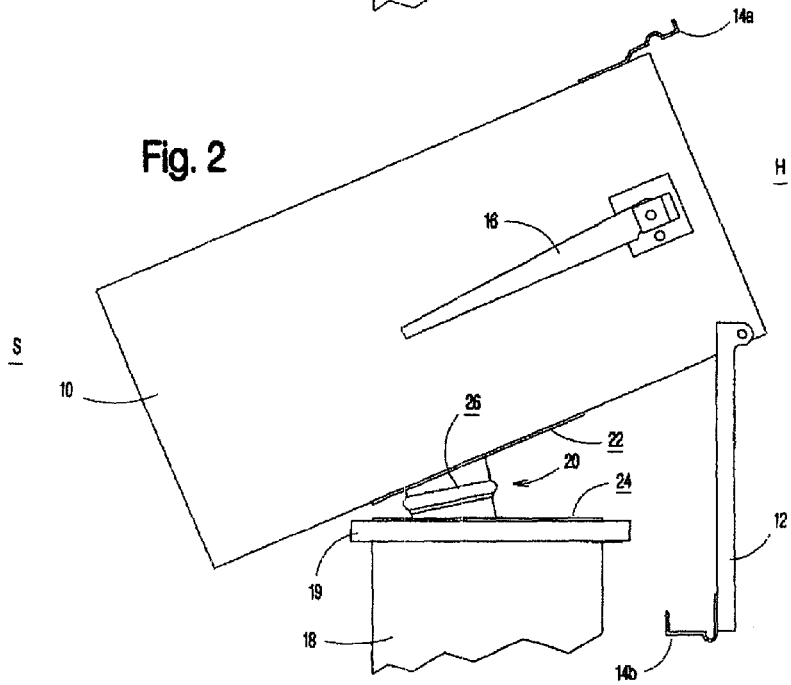
FIG. 2 of the attached drawings shows the mailbox of FIG. 1 rotated toward the house side (h) with the access door open in position for retrieval of mail from the mailbox.

In FIG. 2 the mailbox 10 on its pivoted or swivel mounting has been turned with its door 12 to the back or facing house H and opened. It can be seen in FIG. 2 how because of the mounting angle of the swivel bracket 20 on the post 18 and its attachment through flange 22 to the bottom of the mailbox that the body 10 of the mailbox has been tipped sharply upwardly. This is both an aid to the property owner looking into the mailbox in the usual situation and also brings the greater overhang of the front of the mailbox to a higher elevation so that the force of gravity stores potential energy in the entire mailbox assembly which potential energy then tends to make the mailbox rotate on its swivel mounting bringing such mailbox to a level position by rotating such mailbox one half revolution bringing the front which overlaps the pivot point the most and discharges the most potential energy by straightening the inclination and reversing the mailbox. When the mailbox reaches a level position or a slightly downward incline toward the front it will have reached its equilibrium point with the least potential energy due to gravity and will be in a stable position with respect to gravitational energy. In addition, at such point a detent 50 welded on one end at 52 to the inner side surface of the bearing cap 44 (see FIGS. 3 and 4) of the ball bearing race 26 and with sloped sides 54 will become temporarily engaged with a lock tab or strike plate 36 on downwardly depending collar 32 of top member 22, having an inner surface 34. See in particular FIG. 5. Such engagement of the detent 50 and strike plate 36 will prevent a swinging back and forth or partial back and forth swinging of the mailbox with light gusts of wind, but will not impede complete half revolution of the mailbox by the user.

Figure 3:
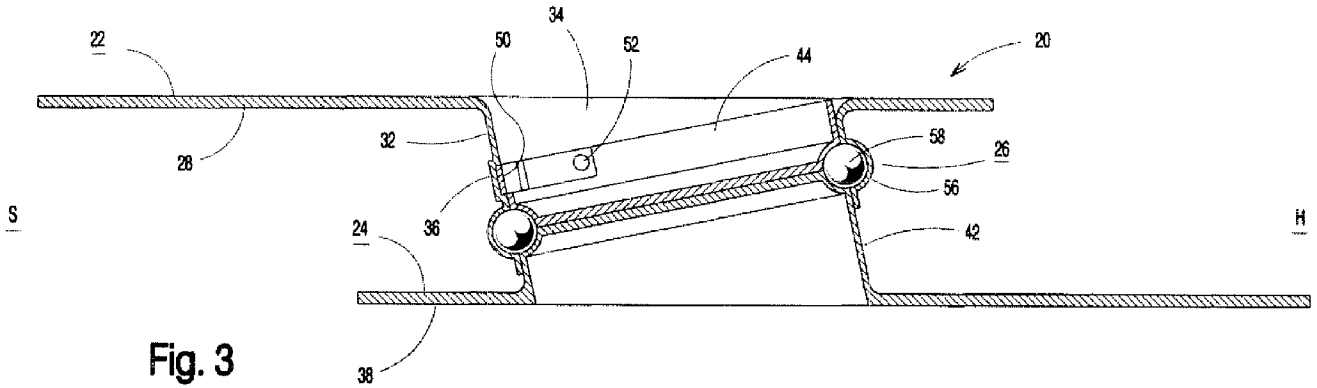
FIG. 3 is a detailed longitudinal section of the canted ball bearing bracket arrangement supporting the mailbox of FIGS. 1 and 2 with the mailbox supporting bracket in level position.
Figure 4:
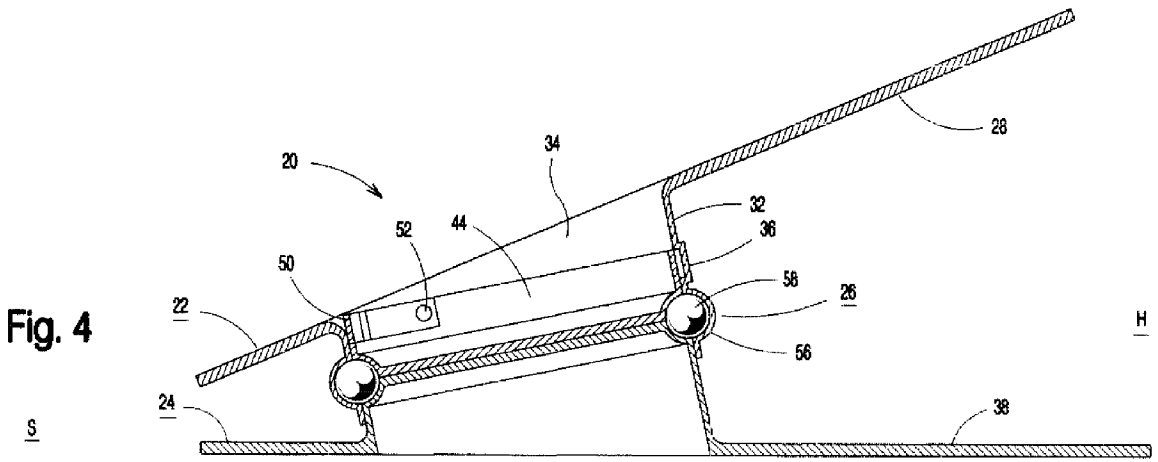
FIG. 4 is a further longitudinal section of the canted ball bearing bracket arrangement of FIG. 3 with the mailbox supporting bracket in canted or inclined position.

The two section views of the rotational device seen in FIGS. 3 and 4 show how the ball bearing race structure or assembly 26 of the swiveling bracket 20 is constructed. At the top is the top member or mounting bracket 22 and at the bottom member 24 also referred to as the bottom mounting plate 38.

Figure 5:
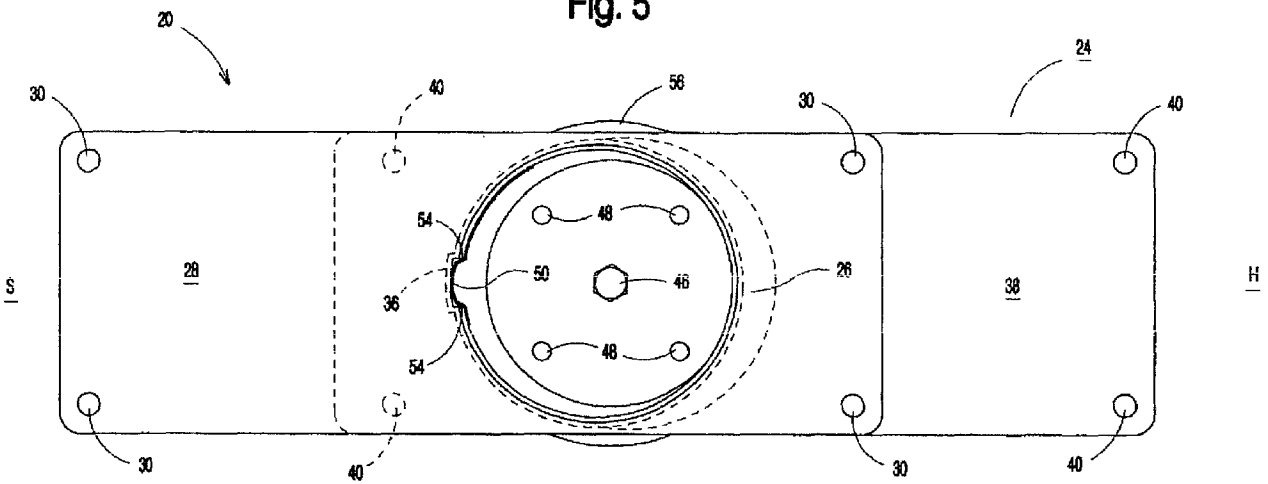
FIG. 5 is a plan view partially in phantom of the canted ball bearing arrangement shown in FIGS. 3 and 4.

It will be noted that the plan view or top view 5 of the swivel bearing assembly in FIG. 5 shows such bearing assembly in the same horizontal position as shown in FIG. 3 from the side for securing to plate 19 on post 18. Collar 32 extends downwardly from top plate 28, while collar 42 extends upwardly from bottom plate 38. Alignment bolt 46 is used to securing bearing cap 44 to collar 42 during welding at points 48. Fastening holes or orifices 30 are provided in the top flange or plate 22 for fastening the mailbox 10 of FIGS. 1 and 2 to the top flange 22 and fastening holes or orifices 40 are provided in flange 24 or the bottom mounting plate 38.

As will be understood from the above, the swivel bottom plate 38 is attached to a mailbox pedestal or post, broadly, in any satisfactory manner at a position such that the mailbox, mounted upon the swivel top plate 28 so the opening of the mailbox is near the outer end of such top plate with the upper plate 28 essentially parallel to the bottom plate 38 and the extreme or farthest end of the two plates positioned opposite to each other with the long end of the top mailbox supporting plate extending toward the road or street S. Thereupon, because of the angle of the plate which forms the mailbox top plate 28 with respect to the canted bearings 58 within their swivel case 26, which is formed by the joining of collar 42, bearing cap 44 and curved section 56 on top collar 32, the outer end of the top plate 28 will be more elevated than at the other end of its circular movement when turned toward the rear or house H. As long as the upper plate 28 and attached mailbox, is held lightly by the user in such position it will remain elevated, i.e. while someone holds or secures it. In such position mail can be retrieved from or deposited in the mailbox. However, when released the gravitational attraction of the earth upon the mailbox and upper plate 28 will urge the plate downwardly and some of such force will, in effect, be deflected to the side, causing the long end of the plate 28 to rotate on the swivel until the lowest potential energy state is attained when the plate 28 rotates downwardly to its lowest point, which happens to be in position at the other side, or loading side of the swivel plate, and mailbox supported thereupon will tend to remain in such rest point or position unless actively swiveled by human intervention to gain access to the mailbox, not shown, mounted upon the top plate 28. In other words the canted ball bearing race 26 supporting the mailbox will tend to rotate until the mailbox reaches its closest approach to the surface of the earth and at the same time, because of the inclination of the ball bearing race 26, bringing the mailbox and its supporting plate toward the road along which the mailbox is positioned.

An alternative arrangement very similar to that shown in FIG. 1 can be made with the notable difference that the mailbox swivel support bottom plate 24 as shown in FIGS. 1 through 5 would be formed essentially into a post cap shape to fit around and be attached by screw-type or other suitable fastenings to the top of a mailbox post. The operation would be the same as described for the arrangement shown.

It should be noted that while the mailbox swivel arrangement of the invention is particularly useful for swiveling a mailbox to bring the box away from the road along which it is mounted to prevent the owner or user of the mailbox from being struck by traffic as a result of standing in or on the side of a road while accessing such mailbox, the invention is also useful in preventing damage to the mailbox due to glancing blows by passing traffic or particularly by passing snow plows or the like during the winter months. In addition, since in the rest position the mailbox mounting is not swivel mounted in appearance except to one already familiar with its construction, the swivel mailbox arrangement is not an attraction for those young at heart who might tend to try to deliberately graze it to see it rotate. Even these types of individuals can be frustrated by applying an outer shroud of some form around the canted bearing structure to hide its form.

As will be recognized from the above description and explanation, the swiveling arrangement of the invention serves as a safety device for the users of mailboxes. It is mounted on the post of the mailbox with the use of angled ball bearings allowing the mailbox to spin and return to a predetermined position by the action of gravity. The device's main feature is that it has low visual impact while performing efficiently and effectively. This device's primary function is to allow safe entry to one's mailbox without stepping into the roadway. A secondary function is also relief from the forces exerted on the mailbox from snow plowing and the like.

While the canted bearing arrangement of the invention is shown and described in its preferred form of a ball bearing raceway, it will be understood that any low friction bearing assembly will be suitable, for example a roller bearing assembly or any other sturdy low friction bearing such as a well lubricated sleeve bearing or the like which will operate efficiently over a period in an outdoor location.

While the present invention has been described in detail and at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A safety promoting mailbox mounting for use along well traveled thoroughfares comprising:

a. a support plate for attachment to an upper portion of a mailbox support, b. a low friction bearing mounted on a first side to the support plate at a low angle with respect to said support plate, c. a mailbox direct support plate mounted upon a second side opposite the first side of the angled low friction bearing, d. the mailbox direct support plate being adapted to extend toward any road along which the direct support plate is mounted, with a mailbox secured upon the direct support plate, when in a balanced position, or when unconstrained, and being at said balanced position substantially parallel to the support plate attached to the upper portion of the mailbox support, e. the mailbox direct support plate being mounted upon the low friction bearing such as to be parallel to the support plate attached to the mailbox support when facing a thoroughfare, but extending upwardly at a low angle when facing away from the thoroughfare, f. whereby the lowest energy point, or rest point, of the mailbox direct support plate and the mailbox supported thereupon, is when the two support plates are substantially parallel with respect to each other and the front of the mailbox direct support plate extends toward the road, this being the balance point and rest point of the mailbox secured to the mailbox support.

2. A safety promoting mailbox mounting in accordance with claim 1 wherein the low friction bearing is a ball bearing race.

3. A safety promoting mailbox mounting in accordance with claim 2 where the rest point, which constitutes the lowest support energy point, of the mailbox direct support plate is with the plate tipped at least slightly downwardly from back to front.

4. A safety promoting mailbox mounting in accordance with claim 1 wherein the low friction bearing is a roller bearing race arrangement.

5. A rotatable mailbox assembly comprising:

a. a roadside mailbox having an access door at one end, b. a mounting bracket for mounting the mailbox upon a substantially vertical support close to a vehicle thoroughfare, c. said bracket including a top member to which said mailbox is secured and a bottom member which is secured to said vertical support, and being provided with a rotationally pivoting means arranged between said top and bottom members allowing the mailbox to be rotated between a first position in which the access door faces the thoroughfare and a second position in which the door faces away from the thoroughfare, d. the pivoting means being angled with respect to a bottom of the mailbox such that the mailbox is disposed essentially level when the access door faces the thoroughfare but inclined upwardly when rotated to face away from the thoroughfare, e. the mailbox and top member having a weight distribution wherein their combined weight is biased toward the one end of the mailbox such that the natural rest point of the mailbox is with the access door toward the thoroughfare, and pivotable in the opposite direction with the exertion of a relatively small force.

6. A rotatable mailbox assembly in accordance with claim 5 wherein the pivoting means is comprised of a friction reducing means.

7. A rotatable mailbox assembly in accordance with claim 6 wherein the friction reducing means is a ball bearing race.

8. A swiveling mailbox support arrangement comprising:

a. a first mailbox support plate for attachment to a lower portion of a mailbox, b. a second mailbox plate for attachment to an upper portion of a ground support means, c. a canted swivel arrangement connecting the two support plates; and d. wherein the first and second plates have a long end and a short end with respect to the canted swivel arrangement, e. wherein at rest position exhibiting the least potential energy the long and short ends of the first and second support plates are opposite each other and wherein at an elevated potential energy position the long and short ends of the first and second support plates are substantially aligned with each other, and f. in which a detent means is provided to aid in maintaining the alignment of the arrangement in the least potential energy position until a minimum energy is applied to bring the alignment to the elevated energy position.

9. A swiveling mailbox support arrangement in accordance with claim 8 wherein the swivel arrangement is a rotating multiple unit rolling element raceway.

10. A swiveling mailbox support arrangement in accordance with claim 8 wherein the swivel arrangement is in the form of a ball bearing raceway.

* * * * *